US008029335B2

(12) United States Patent
Takahashi et al.

(10) Patent No.: US 8,029,335 B2
(45) Date of Patent: Oct. 4, 2011

(54) WAFER PROCESSING METHOD

(75) Inventors: Aki Takahashi, Ota-Ku (JP); Masaaki Nagashima, Ota-Ku (JP)

(73) Assignee: Disco Corporation, Tokyo (JP)

( * ) Notice: Subject to any disclaimer, the term of this patent is extended or adjusted under 35 U.S.C. 154(b) by 502 days.

(21) Appl. No.: 12/349,870

(22) Filed: Jan. 7, 2009

(65) Prior Publication Data

US 2009/0186563 A1 Jul. 23, 2009

(30) Foreign Application Priority Data

Jan. 23, 2008 (JP) ..... 2008-013093

(51) Int. Cl.
*B24B 49/00* (2006.01)

(52) U.S. Cl. ..... 451/11; 451/63; 451/41; 451/57; 257/E21.237; 438/692; 438/959

(58) Field of Classification Search ..... 451/11, 451/57, 63, 41, 58, 285, 287; 257/E21.237; 438/692, 959
See application file for complete search history.

(56) References Cited

U.S. PATENT DOCUMENTS

| | | | | |
|---|---|---|---|---|
| 6,676,491 | B2 * | 1/2004 | Arai et al. | 451/57 |
| 7,527,547 | B2 * | 5/2009 | Kajiyama et al. | 451/41 |
| 7,559,826 | B2 * | 7/2009 | Sekiya | 451/41 |
| 7,622,328 | B2 * | 11/2009 | Masuda | 438/106 |
| 7,731,567 | B2 * | 6/2010 | Sekiya et al. | 451/11 |
| 7,758,402 | B2 * | 7/2010 | Yoshida et al. | 451/11 |
| 2007/0020887 | A1 * | 1/2007 | Sekiya | 438/459 |
| 2007/0141955 | A1 * | 6/2007 | Masuda | 451/11 |

FOREIGN PATENT DOCUMENTS

| | | |
|---|---|---|
| JP | A 2004-281551 | 10/2004 |
| JP | A 2005-123425 | 5/2005 |
| JP | A 2007-173487 | 7/2007 |

* cited by examiner

*Primary Examiner* — George Nguyen
(74) *Attorney, Agent, or Firm* — Greer, Burns & Crain, Ltd.

(57) ABSTRACT

In a wafer processing method, rough grinding using a first grinding stone is divided into first and second steps. In the first step, a wafer is processed into a concave shape at a first transfer rate with a reinforcing rib area slightly left. Thereafter, as primary rough grinding in the second step, the grinding stone is positioned slightly on the inner circumferential side and the wafer is further processed into the concave portion at a second transfer rate faster than the first transfer rate. Since the first transfer rate is suppressed to a rate not to cause a burst chipping, a burst chipping resulting from the second step fast in the processing rate to ensure productivity will occur at the stepped edge portion on the inside of the reinforcing rib area surface. Thus, the flatness of the reinforcing rib area can be ensured.

1 Claim, 7 Drawing Sheets

First step

Second step

Third step

WAFER PROCESSING METHOD

BACKGROUND OF THE INVENTION

1. Field of the Invention

The present invention relates to a wafer processing method for performing grinding processing while leaving a thick reinforcing rib area at the outer circumferential edge of a wafer.

2. Description of the Related Art

Semiconductor chips used in various electronic devices are generally manufactured by the following method. The front surface of a disk-like semiconductor wafer is sectioned along predetermined dividing lines into lattice-like rectangular areas. Electronic circuits are formed on the front surfaces of the areas. Then, the semiconductor wafer is thinly ground from the rear surface and divided along the predetermined dividing lines. Incidentally, electronic devices have significantly been reduced in size and in thickness in the recent years. Along with this, the semiconductor chips are required to have a smaller thickness. Therefore, the semiconductor wafer is needed to be thinner than ever before. However, if the semiconductor wafer is simply thinned, rigidity is reduced, which poses a problem in that the wafer becomes difficult to handle and becomes fragile in the step after the thinning.

To avoid such a problem resulting from the thinning, only a circular device area formed with semiconductor chips is thinly ground from the rear surface side and an outer redundant area on the periphery thereof is left as a relatively thick reinforcing rib area (see e.g. Japanese Patent Laid-open Nos. 2004-281551 and 2005-123425). In this case, since the rear face side is ground, the thick reinforcing rib area projects toward the rear surface side so that the wafer becomes concave in cross-section as a whole. Such a wafer is arbitrarily called "the drum wafer."

In order to prevent trouble such as breakage or the like from occurring in the device area of the drum wafer or in individualized chips, it is necessary to finish the rear surface corresponding to the device area with a grinding stone having a grinding grain diameter as small as possible so as not to leave processing damage to the wafer. However, the wafer with the original thickness may be subjected to grinding processing with a grinding stone composed of fine grinding grains. In such a case, there is a problem in that not only time required for processing lengthens to lower productivity but also the grinding stone wears out fast to increase consumable tool expenses. To eliminate the problem, the drum wafer is roughly ground to some extent before being finish-ground with a grinding stone composed of fine grinding grains (see Japanese Patent Laid-open No. 2007-173487).

However, the rough grinding performed before the finish-grinding is processing whose processing rate is made faster to reduce processing time. Therefore, during the rough grinding, a burst chipping with a size of several hundred μm occurs at several positions in the inner circumferential edge of the outer circumferential reinforcing rib area. In the wafer processing of this type, the drum wafer is reduced in thickness and then stress release is performed by spin etching or the like to remove a fractured layer resulting from the grinding. During such etching, the etching may proceed from the chipping occurring position toward the radially outer circumferential side in accordance with centrifugal force to form a concave portion and cause irregularity in the outer circumferential reinforcing rib area. Thus, while the drum wafer is transferred to a subsequent step with the outer circumferential reinforcing rib area sucked and held, leak occurs at the concave portion to disturb normal suction and holding, thereby causing a transfer error.

SUMMARY OF THE INVENTION

Accordingly, it is an object of the present invention to provide a wafer processing method that can suppress the occurrence of a burst chipping at the inner circumferential edge of a reinforcing rib area during rough grinding to prevent the occurrence of a transfer error without impairing productivity.

In accordance with an aspect of the present invention, there is provided a method of producing a wafer including a device area formed with a plurality of devices on a front surface and a reinforcing rib area formed on a rear surface of an outer circumferential edge surrounding the device area so as to be thicker than the inside thereof, comprising: a first step in which the wafer is held on a suction table from a front surface side and a rear surface of the wafer corresponding to the device area is ground to a concave shape at a first transfer rate by use of a first grinding stone with the outer circumferential edge surrounding the device area left unground; a second step in which the first grinding stone is positioned slightly on the inner circumferential side of a position of the grinding stone in the first step and the wafer is further ground to the concave shape at a second transfer rate faster than the first transfer rate; and a third step in which a second grinding stone with a grinding grain diameter smaller than that of the first grinding stone is used and positioned slightly on the inner circumferential side of a position of the grinding stone in the second step and the wafer is further ground to the concave portion so that the reinforcing rib area is formed on the rear surface of the outer circumferential edge surrounding the device area.

According to the wafer producing method of the present invention, the rough grinding using the first grinding stone is divided into the first and second steps. In the first step, the wafer is ground into the concave shape at the first transfer rate with the reinforcing rib area unground. Then, as the primary rough grinding in the second step, the grinding stone is positioned slightly on the inner circumferential side and the wafer is further ground to the concave shape at the second transfer rate faster than the first transfer rate. Since the first transfer rate is suppressed to a rate not to cause a burst chipping, a burst chipping resulting from the second step fast in the processing rate to ensure productivity will occur at the stepped edge portion on the inside of the reinforcing rib area surface. Thus, the flatness of the reinforcing rib area can be ensured to provide an effect of suppressing an error encountered during the transfer of the wafer with the front surface of the reinforcing rib area sucked and held.

The above and other objects, features and advantages of the present invention and the manner of realizing them will become more apparent, and the invention itself will best be understood from a study of the following description and appended claims with reference to the attached drawings showing some preferred embodiments of the invention.

DETAILED DESCRIPTION OF THE PREFERRED EMBODIMENTS

A description is given of a wafer processing method according to preferred embodiments of the present invention with reference to the drawings. The present invention is not limited to the embodiments and can be modified in various ways without departing from the gist thereof.

Figure 1:
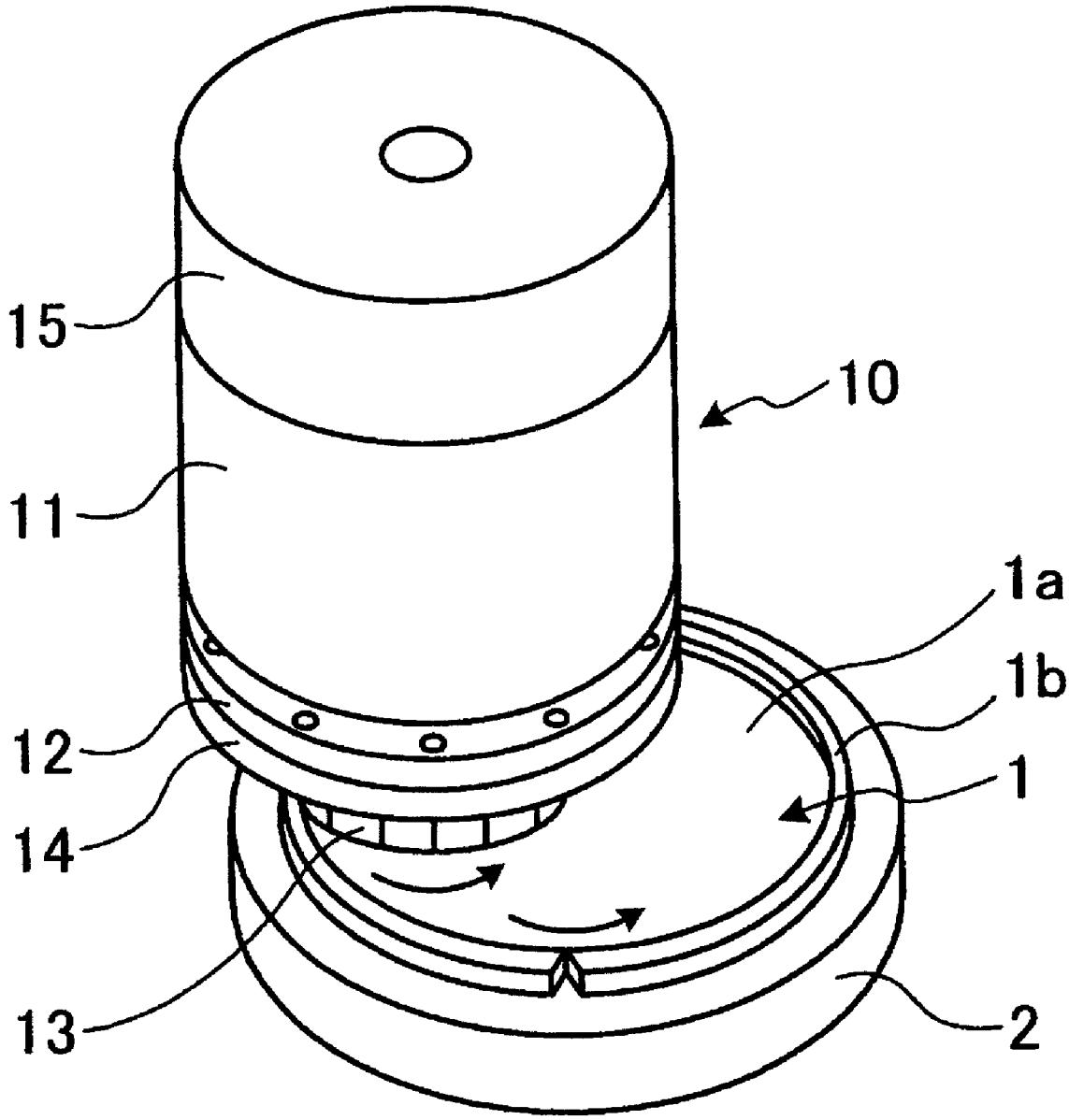
FIG. 1 is perspective view illustrating a configurational example of first grinding means and its associated parts used in first and second steps for rough-grinding, according to an embodiment of the present invention.
Figure 2:
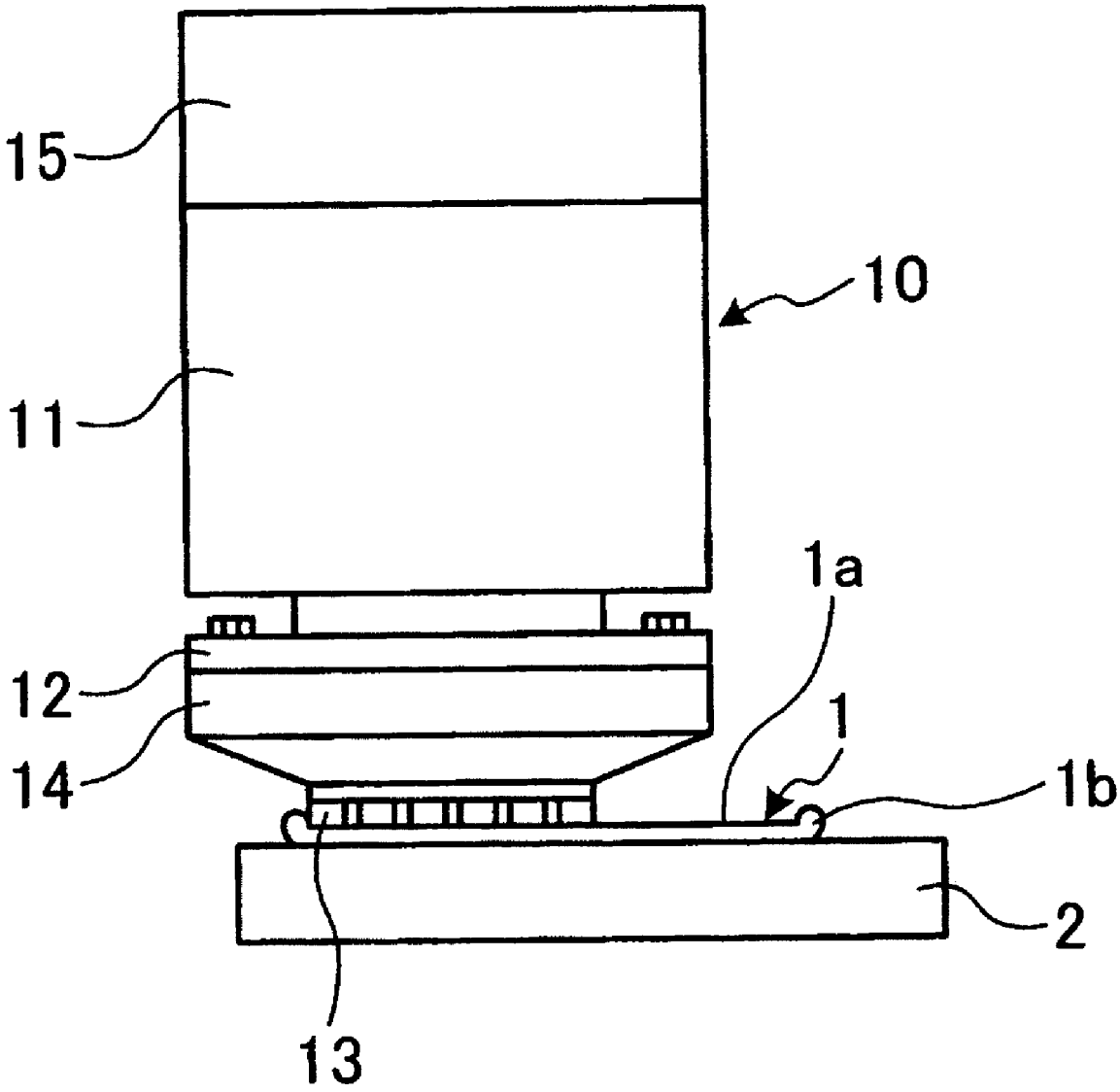
FIG. 2 is a front view of FIG. 1.
Figure 3:
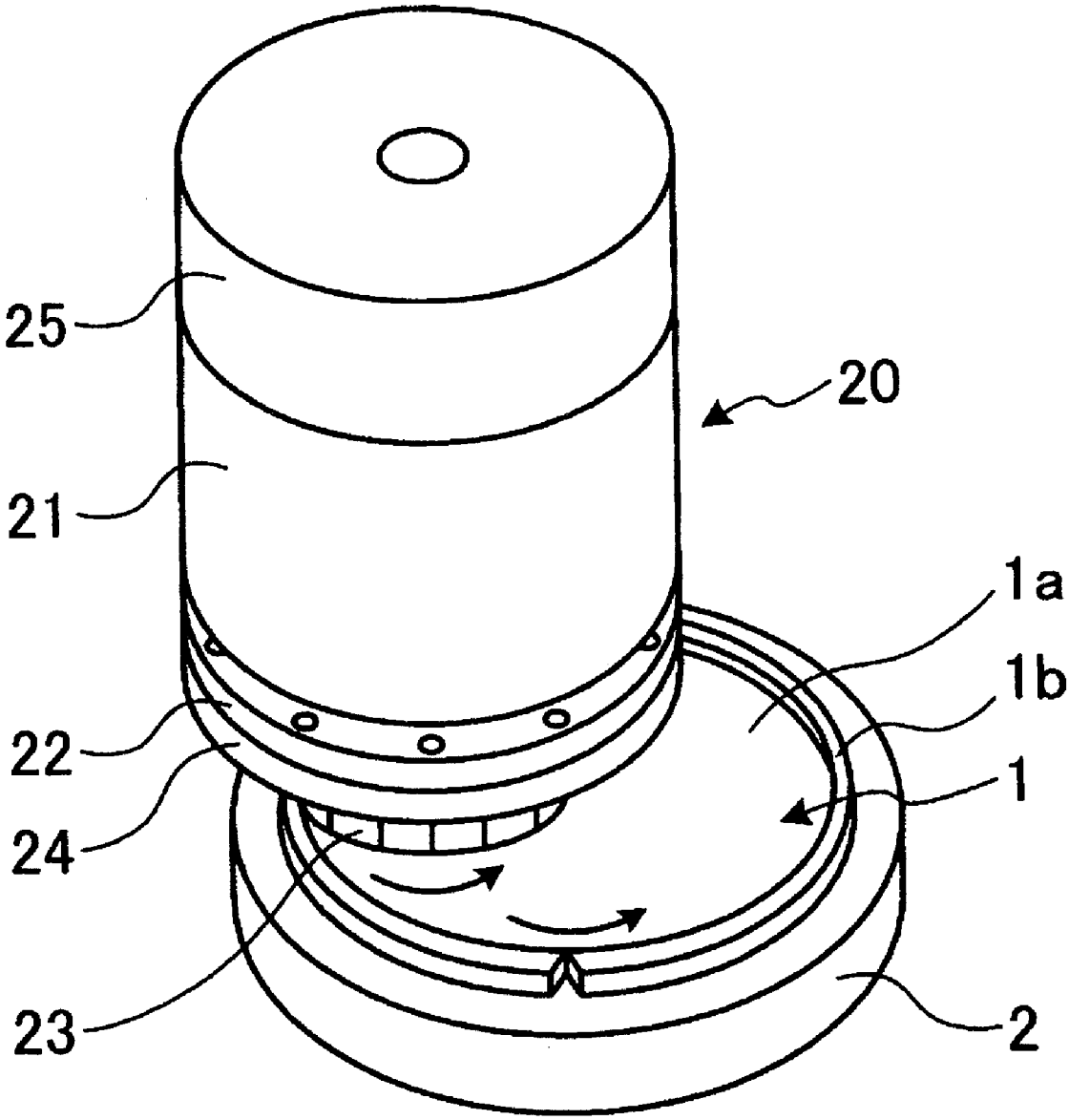
FIG. 3 is a perspective view for illustrating a configurational example of second grinding means and its associated parts used in a third step for finishing grinding, according to the embodiment of the present invention.
Figure 4:
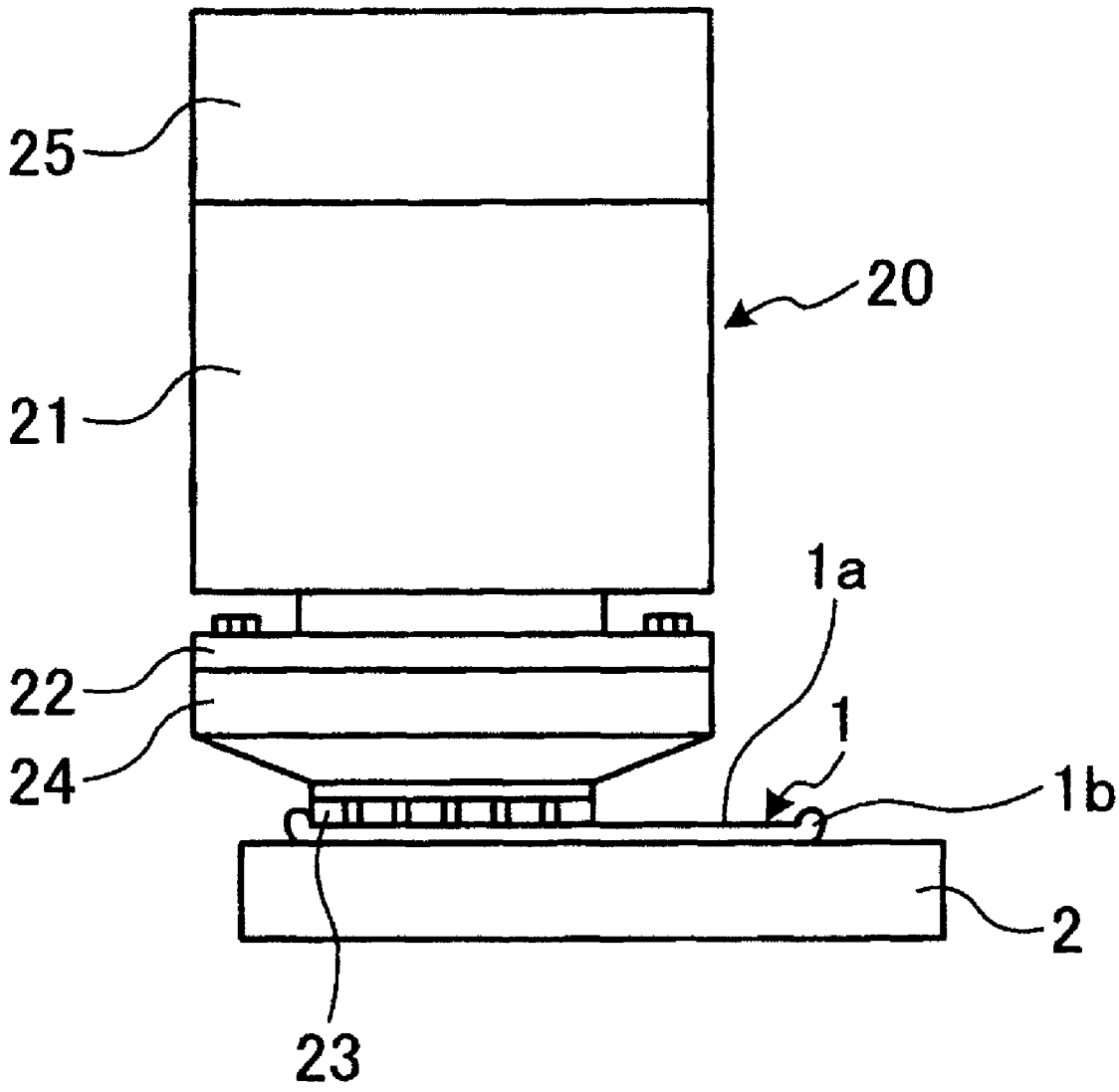
FIG. 4 is a front view of FIG. 3.
Figures 5A, 5B, 5C:
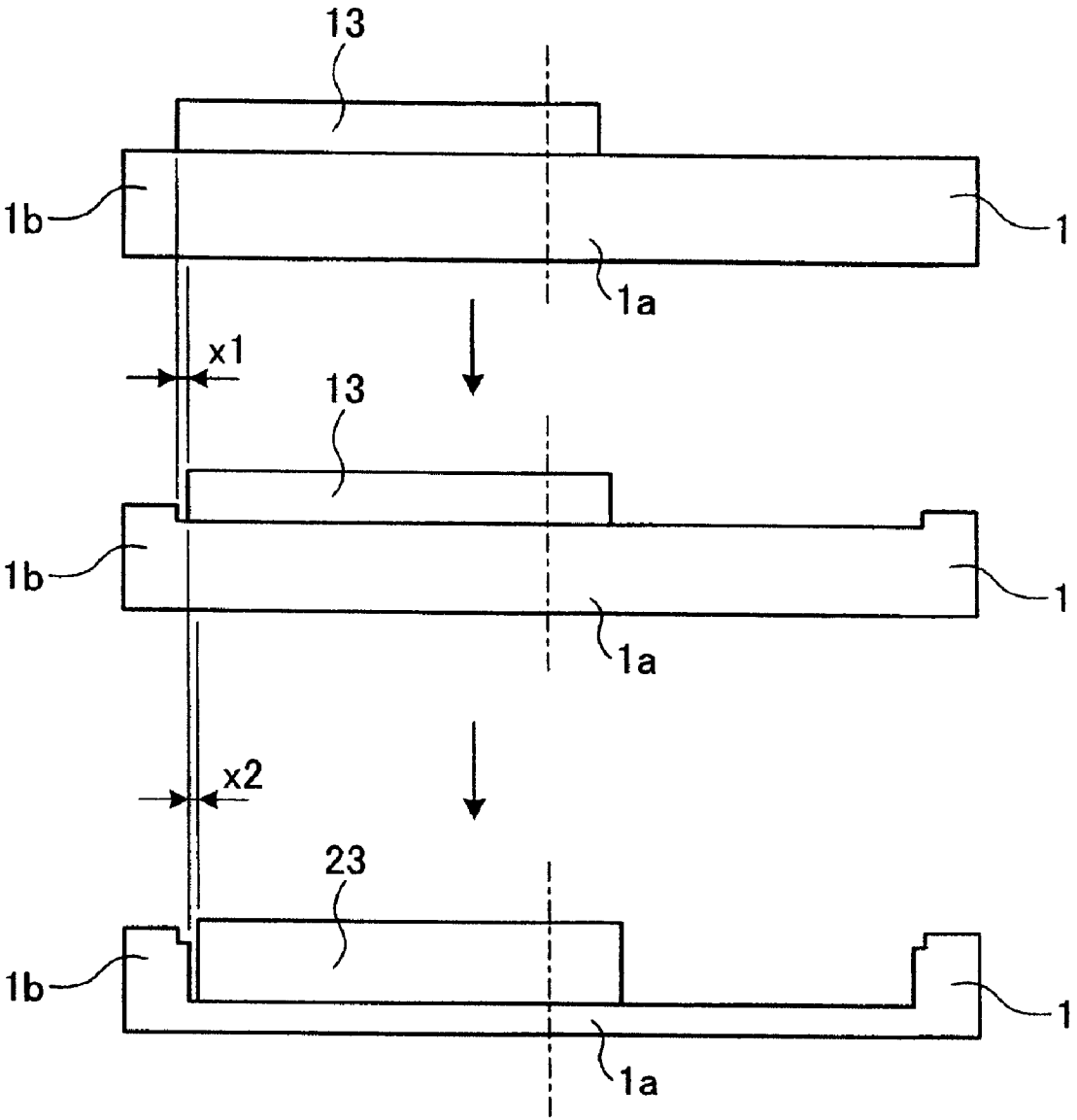
FIGS. 5A to 5C are schematic step diagrams for sequentially illustrating positioning of a grinding stone in the respective steps by way of example.
Figure 6:
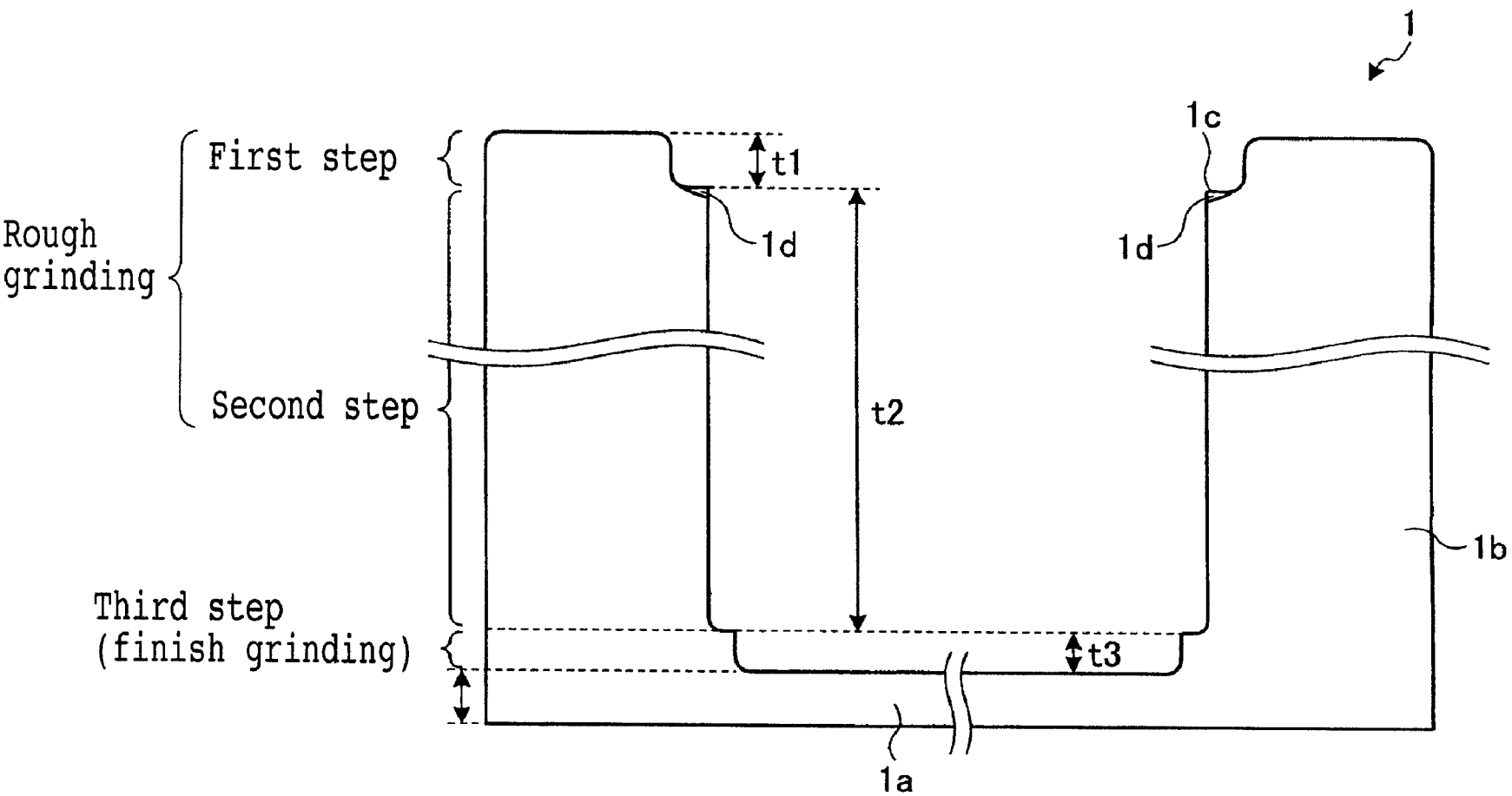
FIG. 6 is an enlarged cross-sectional view of a wafer subjected to processing in the steps by way of example.
Figure 7:
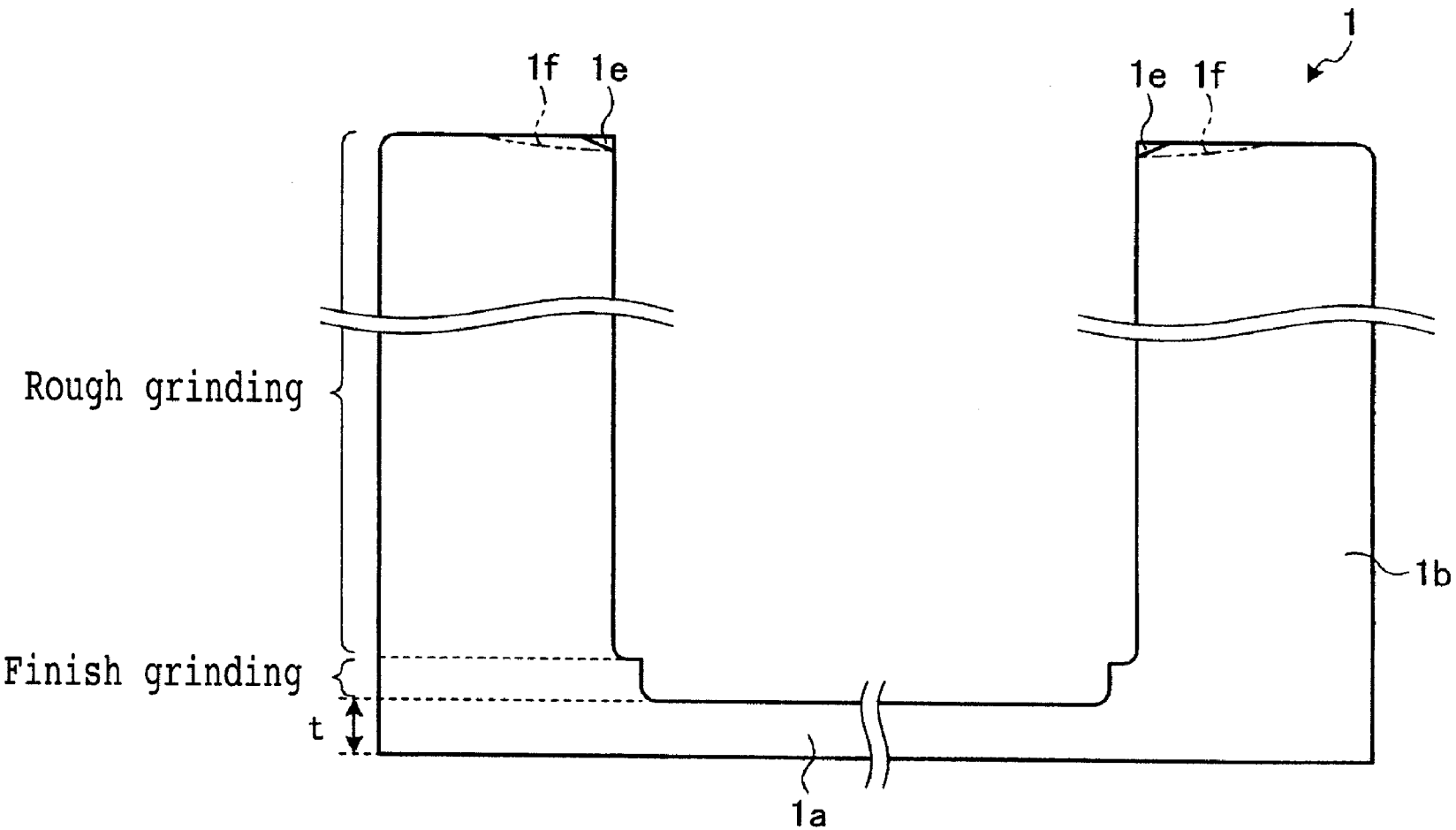
FIG. 7 PRIOR ART
FIG. 7 is a cross-sectional view of a wafer subjected to traditional processing by way of comparative example.

FIG. 1 is a perspective view illustrating a configurational example of first grinding means and its associated parts used in first and second steps for rough grinding. FIG. 2 is a front view of FIG. 1. FIG. 3 is a perspective view illustrating a configurational example of second grinding means and its associated parts used in a third step for finish grinding. FIG. 4 is a front view of FIG. 3. FIGS. 5A to 5C are schematic step diagrams sequentially illustrating positioning of a grinding stone in the respective steps by way of example. FIG. 6 is an enlarged cross-sectional view of a wafer subjected to processing in the steps by way of example. FIG. 7 is a cross-sectional view of a wafer subjected to traditional processing by way of comparative example.

A grinding device for achieving a processing method of the present embodiment includes a suction table 2 adapted to suck and hold a wafer 1 as a workpiece. The suction table 2 is a porous one with a large number of narrow holes communicating with front and rear surfaces and sucks and holds the wafer 1 by a vacuum chucking method. The suction table 2 mentioned above is provided on a disk-like rotatable turntable not shown so as to be positionally displaceable and to be uniquely rotatable in a one direction or in both directions by a rotating drive mechanism.

The grinding device used in the present embodiment includes first grinding means 10 for rough grinding and second grinding means 20 for finish grinding. The first grinding means 10 shown in FIGS. 1 and 2 is opposed to the suction table 2 at a predetermined rough-grinding position of the grinding device and mounted so as to be movable up and down by a support mechanism not shown. In addition, the first grinding means 10 can be grind-transferred by being moved up and down by a first transfer-drive mechanism not shown. The first transfer-drive mechanism includes a ball screw, a ball nut and a motor. The first grinding means 10 is such that a grinding wheel 14 holding a large number of chip-like first grinding stones 13 is mounted to the rotating shaft of a cylinder spindle 11 via a wheel mount 12. Incidentally, in FIGS. 1 and 2, reference numeral 15 denotes a motor for rotating the rotating shaft of the spindle 11. The first grinding stones 13 secured to the lower surface of the wheel mount 12 are formed of resin or vitrified bond abrasive grains having an abrasive grain diameter of e.g. about #32 through 600 and used for rough grinding.

The second grinding means 20 shown in FIGS. 3 and 4 is opposed to a suction table 2 at a predetermined finish-grinding position of the grinding device and mounted so as to be movable up and down by a support mechanism not shown. In addition, the second grinding means 20 can be grind-transferred by being moved up and down by a second transfer-drive mechanism not shown. The second transfer-drive mechanism includes a ball screw, a ball nut and a motor. The second grinding means 20 is such that a grinding wheel 24 holding a large number of chip-like second grinding stones 23 is mounted to the rotating shaft of a cylinder spindle 21 via a wheel mount 22. Incidentally, in FIGS. 3 and 4, reference numeral 25 denotes a motor for rotating the rotating shaft of the spindle 21. The second grinding stones 23 secured to the lower surface of the wheel mount 22 are formed of abrasive grains having an abrasive grain diameter smaller than that of the first grinding stones 13 and used for finish grinding.

Incidentally, the first grinding stones 13 of the first grinding means 10 and the second grinding stones 23 of the second grinding means 20 each have a rotational diameter generally half the diameter of the wafer 1 in order to grind the device area of the wafer 1 without producing an un-ground portion.

A description is next given of a drum wafer processing method according to the embodiment by use of the first and second grinding means 10, 20 described above. A protection tape is first affixed to the front surface of the wafer 1 formed with a semiconductor device on the front surface and subjected to grinding. Specifically, the protection tape is formed by coating an adhesive material with a thickness of about 5 to 20 μm on one surface of a soft substrate film such as polyolefin or the like having a thickness of about 70 to 200 μm. The protection tape is affixed to the wafer 1 in such a manner that the surface coated with the adhesive material is opposed to the front surface of the wafer 1. The protection tape may be made heat-resistant depending on a subsequent step. The wafers 1 affixed with the protection tape on the respective front surfaces are stored in a supply-recovery cassette not shown. One of the wafers 1 is taken out from the supply-recovery mechanism by a transfer mechanism not shown. Such a wafer 1 is reversed and placed on the suction table 2 with the rear surface side facing upside.

A vacuum device of the suction table 2 on which the wafer 1 is placed is operated to suck and hold the front surface of the wafer 1 on the suction table 2 with the rear surface side facing upside and the first step is performed. In the first step, as shown in FIG. 5A, the first grinding stones 13 for rough grinding are positioned on the rear surface of wafer 1 so as to correspond to a device area 1*a*. While being rotated, the grinding wheel 14 is slowly moved downward at a predetermined first transfer rate v1 by the first transfer drive mechanism so that the first grinding stones 13 are pressed against the rear surface of the wafer 1. In this case, also the suction table 2 is drivingly rotated to rotate the wafer 1 thus sucked and held. Thus, preprocessing for rough grinding is performed. A ground amount t1 resulting from the first step is a predetermined amount in which the wafer 1 is processed into a concave shape in cross-section with a reinforcing rib area 1*b* slightly left at an outer circumferential portion as shown in FIG. 6.

Subsequently to the first step, the second step is performed using the first grinding means 10. In the second step, after the wafer 1 is ground to the predetermined thickness (the ground amount t1), the downward processing-transfer of the first grinding means 10 is temporarily stopped and then the first grinding stones 13 are positioned on the inner circumferential side by a slight distance x1 from the position of the grinding stones in the first step as shown in FIG. 5B. While being rotated, the grinding wheel 15 is moved downward by the first transfer drive mechanism at a second transfer rate v2 for primary rough grinding faster than the first transfer rate v1 so that the first grinding stones 13 are pressed against the rear surface of the wafer 1. In this case, also the wafer 1 thus sucked and held is rotated for rough-grinding. Thus, the wafer 1 is further processed into the concave shape. A ground amount t2 resulting from the second step is such a predetermined amount as shown in FIG. 6. In this way, the rough grinding is performed by the first and second steps.

After the second step is completed, a third step is performed using the second grinding means 20. In the third step, the suction table 2 sucking and holding the wafer 1 that has undergone the second step is moved to a position immediately below the second grinding means 20 by the rotation of the turntable. Then, the second grinding stones 23 are positioned on the inner circumferential side by a slight distance x2 from the position of the grinding stones of the second step as shown in FIG. 5C. While being rotated, the grinding wheel 24 is slowly moved downward at a predetermined transfer rate for finish grinding by the second transfer drive mechanism so that the second grinding stones 23 are pressed against the rear surface of the wafer 1. In this case, the wafer 1 thus sucked and held is rotated for finish grinding. The wafer 1 is further processed into the concaved shape. A ground amount t3 resulting from the third step is such a predetermined amount as that the thickness of the device area 1*a* becomes a desired finished thickness t.

By performing the first, second, and third steps described above, the drum wafer is thinly formed that includes the device area 1*a* formed with a plurality of devices on the front surface and the reinforcing rib area 1*b* formed on the rear surface of the outer circumferential edge surrounding the device area 1*a* to have a thickness greater than that of the inside thereof. After the drum wafer is thinned, stress release is performed by spin etching or the like to remove a fractured layer resulting from the grinding and the like. Thereafter, the drum wafer is transferred to the subsequent step by a transfer mechanism sucking and holding the outer circumferential reinforcing rib area 1*b*.

Incidentally, in the embodiment, the second transfer rate v2 of the second step is set at as fast as e.g. 5 to 10 μm/sec taking into account the processing productivity of the drum wafer. However, the first transfer rate v1 is set at as sufficiently slow as e.g. 0.3 to 3.0 μm/sec compared with the second transfer rate v2. Such transfer rates are set to prevent occurrence of a burst chipping. In addition, the ground amount t1 resulting from the first step is set at as slight as e.g. about 10 to 100 μm. The shifted amount x1 of the first grinding stones 13 at the time of the second step is set at as slight as e.g. about 50 to 200 μm.

As in the present embodiment, for the rough grinding, while the first grinding stones 13 are slowly processing-transferred at the first transfer rate v1, the wafer 1 is ground as in the first step. This can prevent the occurrence of a burst chipping at the inner circumferential edge portion of the reinforcing rib area 1*b* when the rough-grinding is started using the first grinding stones 13 for rough grinding. Subsequently to the first step slightly performed, the first grinding stones 13 are used as they are to perform the grinding at the transfer rate v2 for primary rough-grinding in the second step. This ensures the processing productivity of the drum wafer. At the time of starting the second step as described above, because of the fast transfer rate, the wafer 1 may probably cause burst chippings at several positions. In such a case, the burst chippings 1*d* occur at the stepped edge portion 1*c* inwardly of the front surface of the reinforcing rib area 1*b* as shown in FIG. 6. The ground amount t1 and the shifted amount x1 described above are each set in a range where the burst chippings 1*d* located at the stepped edge portion 1*c* and each having a size of several hundred μm do not have an influence on the front surface of the reinforcing rib area 1*b*. The stress release is later performed by spin etching or the like to remove a fractured layer resulting from the grinding and the like. During this etching, the etching may proceed from the chipping occurring position toward the radially outer circumferential side in accordance with centrifugal force to form a concave portion. Even in such a case, the burst chipping 1*d* does not have an influence on the front surface of the reinforcing rib area 1*b*. Thus, the front surface of the reinforcing rib area 1*b* can ensure flatness. As a result, an error can be prevented that may occur while the wafer 1 is later transferred with the front surface of the reinforcing rib area 1*b* sucked and held.

Incidentally, if rough grinding is performed only by the second step without performing the first step, burst chippings 1*e* each having a size of several hundred μm may occur at several positions of the inner circumferential edge of the outer circumferential reinforcing rib area 1*b* as shown in FIG. 7. During the etching of stress release, such burst chippings 1*e* proceed from the chipping occurring positions toward the radially outer circumferential side in accordance with centrifugal force to form concave portions 1*f* as indicated with imaginary lines. Thus, the outer circumferential reinforcing area 1*b* may be formed on the front surface with asperity to cause a transfer error.

The present invention is not limited to the details of the above described preferred embodiments. The scope of the invention is defined by the appended claims and all changes and modifications as fall within the equivalence of the scope of the claims are therefore to be embraced by the invention.

What is claimed is:

1. A method of producing a wafer including a device area formed with a plurality of devices on a front surface and a reinforcing rib area formed on a rear surface of an outer circumferential edge surrounding the device area so as to be thicker than the inside thereof, comprising:

a first step in which the wafer is held on a suction table from a front surface side and a rear surface of the wafer corresponding to the device area is ground to a concave shape at a first transfer rate by use of a first grinding stone with the outer circumferential edge surrounding the device area left unground;

a second step in which the first grinding stone is positioned slightly on the inner circumferential side of a position of the grinding stone in the first step and the wafer is further ground to the concave shape at a second transfer rate faster than the first transfer rate; and a third step in which a second grinding stone with a grinding grain diameter smaller than that of the first grinding stone is used and positioned slightly on the inner circumferential side of a position of the grinding stone in the second step and the wafer is further ground to the concave portion so that the reinforcing rib area is formed on the rear surface of the outer circumferential edge surrounding the device area.

* * * * *